US009841691B2

(12) United States Patent
Kouyama et al.

(10) Patent No.: US 9,841,691 B2
(45) Date of Patent: Dec. 12, 2017

(54) METHOD OF MANUFACTURING ELECTROSTATIC LATENT IMAGE DEVELOPING TONER

(71) Applicant: Konica Minolta Inc., Tokyo (JP)

(72) Inventors: Mikio Kouyama, Kunitachi (JP); Hiroyuki Fukuda, Sanda (JP); Shiro Hirano, Hachioji (JP); Asao Matsushima, Hino (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 14/837,600

(22) Filed: Aug. 27, 2015

(65) Prior Publication Data

US 2016/0070185 A1 Mar. 10, 2016

(30) Foreign Application Priority Data

Sep. 5, 2014 (JP) ..... 2014-180757

(51) Int. Cl.
*G03G 9/087* (2006.01)
*G03G 9/08* (2006.01)

(52) U.S. Cl.
CPC ..... *G03G 9/0806* (2013.01); *G03G 9/08711* (2013.01); *G03G 9/08755* (2013.01)

(58) Field of Classification Search
CPC ..... G03G 9/0806; G03G 9/0804; G03G 9/08755; G03G 9/08711
USPC ..... 430/109.4, 137.11, 137.14
See application file for complete search history.

(56) References Cited

U.S. PATENT DOCUMENTS

2014/0349231 A1* 11/2014 Shirai ..... G03G 9/0825 430/109.4
2015/0234306 A1* 8/2015 Kouyama ..... G03G 9/08764 430/109.4

FOREIGN PATENT DOCUMENTS

JP 2012133161 A 7/2012
JP 2012255957 A 12/2012

OTHER PUBLICATIONS

Japanese Patent Office J-Plat-Pat machine-assisted English language translaton of Japanese Patent 2012-255957 A (pub. Dec. 2012).*
Notice of Reasons for Rejection dated Sep. 20, 2016 from corresponding Japanese Application; Patent Application No. 2014-180757; English translation of Notice of Reasons for Rejection; Total of 12 pages.
Tokiyuki Yoshida et al., Handbook of Surfactants, New version, Japan, Kogaku Tosho Kabushiki Kaisha, May 20, 2000, 4th Edit, p. 121.

* cited by examiner

*Primary Examiner* — Janis L Dote
(74) *Attorney, Agent, or Firm* — Lucas & Mercanti, LLP

(57) ABSTRACT

A method of manufacturing an electrostatic latent image developing toner made of a binding resin made of an amorphous resin and a crystalline resin, and toner particles containing a releasing agent and a coloring agent, the method includes: adding a monomer for forming the amorphous resin, in an aqueous medium, under presence of the fine particles containing the crystalline resin, and performing polymerization to obtain coated resin fine particles that are fine particles containing the crystalline resin, the fine particles being coated with the amorphous resin; and flocculating and fusing at least fine particles containing the amorphous resin, the coated resin fine particles, and fine particles containing the coloring agent, in an aqueous medium, under presence of a flocculating agent, to obtain the toner particles, wherein a surfactant having concentration of one to five times critical micellar concentration is added to the aqueous medium in the polymerization.

16 Claims, No Drawings

METHOD OF MANUFACTURING ELECTROSTATIC LATENT IMAGE DEVELOPING TONER

The entire disclosure of Japanese Patent Application No. 2014-180757 filed on Sep. 5, 2014 including description, claims, drawings, and abstract are incorporated herein by reference in its entirety.

BACKGROUND OF THE INVENTION

Field of the Invention

The present invention relates to a method of manufacturing an electrostatic latent image developing toner used for image formation in electrophotographic image formation.

Description of the Related Art

As an electrostatic latent image developing toner (hereinafter, also simply referred to as "toner") used in electrophotographic image formation, a toner that is more excellent in low-temperature fixability has been desired to achieve energy saving and an increase in speed of an image formation device. As such a toner, a toner that can be fixed at a low temperature due to a sharp melt property of a crystalline resin, by use of the crystalline resin together with an amorphous resin, as a binding resin.

As the crystalline resin, a crystalline polyester resin is typically known. Further, according to a toner using a urethane-modified crystalline polyester resin that is a combination of a polyester-based polymerized segment and a urethane-based polymerized segment, as the crystalline resin, a decrease in viscoelasticity in a high-temperature region at the time of heat fixation is suppressed, along with the sharp melt property of the crystalline resin. Therefore, occurrence of an off-set phenomenon is effectively suppressed.

However, when such a toner using the urethane-modified crystalline polyester resin is manufactured by a polymerization method, a problem like below is caused. That is, in the manufacturing of the toner by the polymerization method, fine particles of components of various toner particles are flocculated and fused in an aqueous medium, and the toner particles are obtained. However, for example, while a vinyl resin is typically used as the amorphous resin, the vinyl resin and the urethane-modified crystalline polyester resin are less likely compatible with each other. Therefore, fusion of the fine particles of the vinyl resin and the fine particles of the urethane-modified crystalline polyester resin at a fine particle interface is less likely to be facilitated. As a result, resultant toner particles become a toner with low mechanical strength.

To solve such a problem, a toner made of toner particles obtained such that the urethane-modified crystalline polyester resin particles are layered on a surface of a toner mother particles made of the amorphous resin has been proposed (for example, JP 2012-133161 A).

However, in the toner disclosed in JP 2012-133161 A, a crystalline resin component is exposed on a surface of the toner particles in the state of being layered on the surface of the toner mother particles. Therefore, there is a problem that the toner particles are more likely to cause heat fusion, due to an increase in temperature in the image forming device. Therefore, a heat-resistant storage property cannot be sufficiently obtained. Further, there are problems that the fixability is decreased due to compatibility between the crystalline resin and the amorphous resin in the toner mother particles at the time of heat fixing, and a document offset occurs.

SUMMARY OF THE INVENTION

The present invention has been made in view of the foregoing, and an object thereof is to provide a method of manufacturing an electrostatic latent image developing toner that can obtain excellent low-temperature fixability, sufficient heat-resistance storage property, and excellent mechanical strength.

To achieve the abovementioned object, according to an aspect, a method of manufacturing an electrostatic latent image developing toner made of a binding resin made of an amorphous resin and a crystalline resin, and toner particles containing a releasing agent and a coloring agent, the method reflecting one aspect of the present invention comprises: a polymerization step of adding a monomer for forming the amorphous resin, in an aqueous medium, under presence of the fine particles containing the crystalline resin and performing polymerization to obtain coated resin fine particles that are fine particles containing the crystalline resin, the fine particles being coated with the amorphous resin; and a flocculation and fusion step of flocculating and fusing at least fine particles containing the amorphous resin, the coated resin fine particles, and fine particles containing the coloring agent, in an aqueous medium, under presence of a flocculating agent, to obtain the toner particles, wherein a surfactant having concentration of one to five times critical micellar concentration is added to the aqueous medium in the polymerization step.

In the method of manufacturing an electrostatic latent image developing toner of the present invention, the crystalline resin is preferably made of a crystalline polyester resin and/or a urethane-modified crystalline polyester resin that is a combination of a crystalline polyester-based polymerized segment and a urethane-based polymerized segment, and a melting point of the crystalline resin is preferably 50 to 90° C.

In the method of manufacturing an electrostatic latent image developing toner of the present invention, when the crystalline resin contains the urethane-modified crystalline polyester resin, a carboxyl group is preferably included in a molecular end of the urethane-modified crystalline polyester resin and/or in the urethane-based polymerized segment that constitutes the urethane-modified crystalline polyester resin, and an acid value of the urethane-modified crystalline polyester resin is preferably 9 to 20 mgKOH/g.

In the method of manufacturing an electrostatic latent image developing toner of the present invention, an ethylenically unsaturated monomer containing a carboxyl group is preferably used as the monomer for forming the amorphous resin.

In the method of manufacturing an electrostatic latent image developing toner of the present invention, the fine particles containing the crystalline resin are preferably fine particles containing both of the crystalline resin and the releasing agent.

In the method of manufacturing an electrostatic latent image developing toner of the present invention, the fine particles containing the amorphous resin are preferably fine particles containing both of the amorphous resin and the releasing agent.

In the method of manufacturing an electrostatic latent image developing toner of the present invention, the fine particles containing the amorphous resin are preferably obtained by polymerizing fine particles that are mixed and emulsified monomer for forming the amorphous resin and releasing agent, in an aqueous medium.

In the method of manufacturing an electrostatic latent image developing toner of the present invention, in the polymerization step, the coated resin fine particles that are fine particles containing the crystalline resin, the fine particles being coated with the amorphous resin, and releasing agent-containing amorphous resin fine particles that are fine particles containing the releasing agent, the fine particles being coated with the amorphous resin, are preferably obtained by adding a monomer for forming the amorphous resin and performing polymerization, under presence of the fine particles containing the crystalline resin and the fine particles containing the releasing agent, and in the flocculation and fusion step, the releasing agent-containing amorphous resin fine particles are preferably flocculated and fused, together with the fine particles containing the amorphous resin, the coated resin fine particles, and the fine particles containing the coloring agent.

DESCRIPTION OF THE PREFERRED EMBODIMENTS

Hereinafter, an. embodiment of the present invention will be described. However, the scope of the invention is not limited to the illustrated examples.

A method of manufacturing a toner of the present invention is a method of manufacturing an electrostatic latent image developing toner made of a binding resin made of an amorphous resin and a crystalline resin, and toner particles containing a releasing agent and a coloring agent, the method including a polymerization step of adding a monomer for forming the amorphous resin, in an aqueous medium, under presence of the fine particles containing the crystalline resin, and performing polymerization to obtain coated resin fine particles that are fine particles containing the crystalline resin, the fine particles being coated with the amorphous resin, and a flocculation and fusion step of flocculating and fusing at least fine particles containing the amorphous resin, the coated resin fine particles, and fine particles containing the coloring agent, in an aqueous medium, under presence of a flocculating agent, to obtain the toner particles.

A specific example of a method of manufacturing a toner of the present invention is configured from:

(1) a step of preparing a coloring agent fine particle dispersion, in which a coloring agent is dispersed in an aqueous medium and a coloring agent fine particle dispersion is prepared;

(2) a step of preparing a crystalline resin particle dispersion, in which a crystalline resin is dispersed in an aqueous medium and a dispersion of fine particles containing the crystalline resin (hereinafter, also referred to as "crystalline resin particles") is prepared;

(3) a polymerization step, in which a monomer for forming an amorphous resin is added in an aqueous medium, under the presence of the crystalline resin particles, and polymerization is performed, so that coated resin fine particles that is the crystalline resin particles coated with the amorphous resin are obtained;

(4) a flocculation and fusion step, in which fine particles containing the amorphous resin, the coated resin fine particles, and fine particles containing the coloring agent are flocculated and fused in an aqueous medium, under the presence of a flocculating agent, so that flocculated particles are formed;

(5) a ripening step, in which the flocculated particles are ripened by thermal energy and shape adjustment is performed, and a toner particle dispersion is prepared;

(6) a cooling step, in which the toner particle dispersion is cooled;

(7) a filtration and washing step, in which solid-liquid separation of the toner particles is performed from the cooled toner particle dispersion, and the flocculating agent, a flocculation terminator, a surfactant, and the like are removed from the surface of the toner particles;

(8) a drying step, in which the washed toner particles are dried; and (9) an external additive addition step, in which an external additive is added to the dried toner particles can be added, as needed.

In the present invention, the "aqueous medium" means a medium composed of 50 to 100% by mass of water, and 0 to 50% by mass of a water-soluble organic solvent. The water-soluble organic solvent is exemplified by methanol, ethanol, isopropanol, butanol, acetone, methyl ethyl ketone, and tetrahydrofuran. An alcoholic organic solvent unlikely to dissolve the resultant resin is favorable.

(1) Step of Preparing a Coloring Agent Fine Particle Dispersion

The coloring agent fine particle dispersion can be obtained by dispersing the coloring agent into the aqueous medium. From the perspective of uniform dispersion of the coloring agent, the surfactant concentration in the aqueous medium is favorably kept not lower than the critical micellar concentration (CMC). Conventionally known various dispersing apparatuses can be used as a dispersing apparatus usable for dispersing the coloring agent.

[Coloring Agent]

As the coloring agent, typically known dyes and pigments can be used.

As the coloring agent for obtaining a black toner, various known agents can be arbitrarily used, including carbon black such as furnace black and channel black, ferromagnetic materials such as ferrite and magnetite, dyes, inorganic pigments including nonmagnetic iron oxide.

As the coloring agent for obtaining color toners, conventionally known agents can be used, including organic pigments and dyes. Specific examples of the organic pigments include: C.I. pigment red 5, C.I. pigment red 48:1, C.I. pigment red 48:2, C.I. pigment red 48:3, C.I. pigment red 53:1, C.I. pigment red 57:1, C.I. pigment red 81:4, C.I. pigment red 122, C.I. pigment red 139, C.I. pigment red 144, C.I. pigment red 149, C.I. pigment red 166, C.I. pigment red 177, C.I. pigment red 178, C.I. pigment red 222, C.I. pigment red 238, C.I. pigment red 269, C.I. pigment yellow 14, C.I. pigment yellow 17, C.I. pigment yellow 74, C.I. pigment yellow 93, C.I. pigment yellow 94, C.I. pigment yellow 138, C.I. pigment yellow 155, C.I. pigment yellow 180, C.I. pigment yellow 185, C.I. pigment orange 31, C.I. pigment orange 43, C.I. pigment blue 15:3, C.I. pigment blue 60, and C.I. pigment blue 76. Examples of the dyes include: C.I. solvent red 1, C.I. solvent red 49, C.I. solvent red 52, C.I. solvent red 58, C.I. solvent red 68, C.I. solvent red 11, C.I. solvent red 122, C.I. solvent yellow 19, C.I. solvent yellow 44, C.I. solvent yellow 77, C.I. solvent yellow 79, C.I. solvent yellow 81, C.I. solvent yellow 82, C.I. solvent yellow 93, C.I. solvent yellow 98, C.I. solvent yellow 103, C.I. solvent yellow 104, C.I. solvent yellow 112, C.I. solvent yellow 162, C.I. solvent blue 25, C.I. solvent blue 36, C.I. solvent blue 69, C.I. solvent blue 70, C.I. solvent blue 93, and C.I. solvent blue 95.

The coloring agents for obtaining the color toners can be used by one type alone, or by a combination of two or more types of aforementioned examples.

The content ratio of the coloring agent to 100 parts by mass of a binding resin is favorably 1 to 20 parts by mass, and is more favorably 4 to 15 parts by mass.

[Surfactant]

Examples of surfactants includes anionic surfactants such as alkyl sulfate ester salt, polyoxyethylene(n) alkyl ether sulfonic acid salt, alkylbenzenesulfonic acid salt, α-olefin-sulfonic acid salt, and phosphoric ester, cationic surfactants including amine salt-type cationic surfactants such as alkylamine salt, amino alcohol fatty acid derivative, polyamine fatty acid derivative, and imidazoline, and quaternary ammonium salt-type cationic surfactants such as alkyltrimethylammonium salt, dialkyldimethylammonium salt, alkyldimethylbenzyl ammonium salt, pyridinium salt, alkyl isoquinolinium salt, and benzethonium chloride, nonionic surfactants such as fatty acid amide derivative, and polyhydric alcohol derivative, and amphoteric surfactants such as alanine, dodecyl di(aminoethyl) glycine, di(octylaminoethyl) glycine, and N-alkyl-N,N-dimethyl ammonium betaine. Further, an anionic surfactant or a cationic surfactant including a fluoroalkyl group can be used.

The dispersion diameter of the coloring agent fine particles in the coloring agent fine particle dispersion prepared in the step of preparing a coloring agent fine particle dispersion is favorably 10 to 300 nm in the volume-based median diameter.

The volume-based median diameter of the coloring agent fine particles in the coloring agent fine particle dispersion is measured using an electrophoretic light scattering photometer "ELS-800" (manufactured by Otsuka Electronics Co., Ltd.).

(2) Step of Preparing a Crystalline Resin Particle Dispersion

In this step, a dispersion of crystalline resin particles is prepared, by dispersing a crystalline resin in an aqueous medium.

In the present invention, the crystalline resin particles may be fine particles that contains both of the crystalline resin and a releasing agent.

In this step, an example of a method of dispersing the crystalline resin in an aqueous medium includes a method of preparing an oil phase solution by dissolving or dispersing the crystalline resin in an organic solvent and preparing an aqueous medium (aqueous phase) containing the surfactant, adding the oil phase solution to the aqueous phase, and performing emulsification using mechanical shearing force, by for example, high-speed stirring, or ultrasonic irradiation, and forming oil droplets, and then removing the organic solvent by depressurization or the like. In this step, when the crystalline resin has acid value, a basic compound is dissolved in the organic solvent or the aqueous phase in advance, so that a carboxyl group of the crystalline resin is neutralized, and a stable emulsified liquid can be prepared, accordingly.

Further, a so-called phase inversion emulsification method, in which the aqueous phase is added to the oil phase solution, can be used. When the phase inversion emulsification method is used, it is favorable to dissolve the basic compound related to the neutralization of the carboxyl group, in an organic solvent.

When the fine particles containing both of the crystalline resin and the releasing agent are prepared as the crystalline resin particles, the oil phase solution may just be prepared as a dispersion obtained such that both of the crystalline resin and the releasing agent are dissolved or dispersed in an organic solvent. In this case, a urethane-modified crystalline polyester resin is dissolved in the organic solvent, and then the releasing agent is added, and the oil phase solution kept to a temperature of the melting point of the releasing agent or more is added to the aqueous phase held to the same temperature, so that the oil phase solution can be emulsified.

As the basic compound that can be dissolved in the aqueous phase, an inorganic alkali compound such as sodium hydroxide, potassium hydroxide, or lithium hydroxide can be used. Further, as the basic compound that can be dissolved in the organic solvent, an organic alkali compound such as trimethylamine, triethylamine, or tripropylamine can be used.

The amount of the aqueous medium to 100 parts by mass of the oil phase solution is favorably 50 to 2,000 parts by mass.

When the amount of the aqueous medium falls within the aforementioned range, the oil phase solution can be emulsified and dispersed in a desired particle size in the aqueous medium.

As a usable surfactant, those similar to the aforementioned surfactants can be exemplified.

As the organic solvent used for preparation of the oil phase solution, one having a low boiling point and low solubility in water is favorable from the perspective of easy removal treatment after the formation of the oil droplets. To be specific, examples of the organic solvent include methyl ethyl ketone, methyl isobutyl ketone, ethyl acetate, benzene, toluene, and xylene. Among them, it is favorable to use methyl ethyl ketone, methyl isobutyl ketone, or ethyl acetate. These organic solvents may be used by one type alone, or by a combination of two or more types of aforementioned examples.

The amount of the organic solvent to 100 parts by mass of the crystalline resin is usually 1 to 300 parts by mass, favorably 1 to 100 parts by mass, and more favorably 25 to 70 parts by mass.

The average particle size of the crystalline resin particles obtained in this step favorably falls in the range from 80 to 300 nm, and more favorably in the range from 90 to 250 nm in volume-based median diameter.

The average particle size of the crystalline resin particles can be adjusted by controlling the concentration of the surfactant in the aqueous medium and the degree of neutralization of the carboxyl group.

The volume-based median diameter is measured by using "UPA-150" (manufactured by Microtrac Inc.).

[Crystalline Resin]

In the present invention, the crystalline resin refers to a resin having a clear melting peak in differential scanning calorimetry (DSC), instead of exhibiting stepwise endothermic amount change. To be specific, the clear melting peak means a peak having a half-value width of the melting peak in a second heating process is within 15° C., in a DSC curve obtained in the differential scanning calorimetry.

The crystalline resin that constitutes the binding resin according to the present invention is favorably the crystalline polyester resin, and/or a urethane-modified crystalline polyester resin that is a combination of a crystalline polyester-based polymerized segment and a urethane-based polymerized segment.

The urethane-modified crystalline polyester resin can obtain stronger intermolecular interaction due to the presence of the urethane bond, than the crystalline polyester resin that is not urethane-modified. Therefore, when the crystalline resin that constitutes the binding resin is the urethane-modified crystalline polyester resin, sufficient viscoelasticity can be maintained as the binging resin as a whole, even if the temperature becomes high at the time of heat fixation. Therefore, low-temperature fixation can be achieved, and excessive increase in glossiness of a formed fixed image can be suppressed. Further, due to the high intermolecular interaction, phase separability from the amorphous resin made of a vinyl resin is secured at the time of storing the toner, and in the cooled fixed image after the heat fixation, and sufficient heat-resistant storage property and document offset resistance can be obtained.

Hereinafter, the urethane-modified crystalline polyester resin will be described.

[Melting Point of Urethane-Modified Crystalline Polyester Resin]

The melting point of the urethane-modified crystalline polyester resin is favorably 50 to 90° C., more favorably 50 to 85° C., and still more favorably 55 to 80° C.

When the melting point of the urethane-modified crystalline polyester resin falls within the above range, both of sufficient low-temperature fixability and excellent heat-resistant storage property can be reliably obtained.

The melting point of the urethane-modified crystalline polyester resin can be controlled by the composition of polyvalent carboxylic acid and polyhydric alcohol.

Here, the melting point of the urethane-modified crystalline polyester resin is a peak top temperature of the melting peak in the second heating process, in the DSC curve obtained by the differential scanning calorimetry of sole urethane-modified crystalline polyester resin. When there is a plurality of melting peaks in the DSC curve, a top peak temperature of the melting peak having the maximum endothermic amount is the melting point.

[Molecular Weight of Urethane-Modified Crystalline Polyester Resin]

A weight average molecular weight (Mw) calculated from molecular weight distribution measured by gel permeation chromatography (GPC) of the urethane-modified crystalline polyester resin is favorably 25,000 to 65,000, and more favorably 28,000 to 60,000.

Measurement of the molecular weight by GPC is performed in the following manner. An apparatus "HLC-8220" (manufactured by TOSO Co., Ltd.) and a column "TSK guard column+TSK gel Super HZM-M three-stranded" (manufactured by TOSO Co.,Ltd.) are used, and tetrahydrofuran (THF) as a carrier solvent is allowed to flow at a flow rate of 0.2 ml/min, while a column temperature is aintained at 40° C. A measurement sample (urethane-modified crystalline polyester resin) is dissolved in tetrahydrofuran (THF) at room temperature and is processed for 5 minutes by an ultrasonic disperser to obtain a solution at the concentration of 1 mg/ml. Subsequently, the solution is filtered with a membrane filter having a pore size of 0.2 μm to obtain a sample solution. 10 μL of the obtained sample solution is injected into the apparatus together with the foregoing carrier solvent and detected by using a refractive index detector (RI detector). The molecular weight distribution of the measurement sample is calculated by use of a calibration curve that has been prepared by using monodisperse polystyrene standard particles to determine the molecular weight. As the standard polystyrene samples used for the calibration curve measurement, those of molecular weights of $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$, and $4.48\times10^6$, manufactured by Pressure Chemical Co. is used. The calibration curve has been prepared using at least ten of these standard polystyrene samples. A refractive index detector is used as a detector.

The weight average molecular weight (Mw) calculated by the gel permeation chromatography (GPC) of the crystalline polyester-based polymerized segment that constitutes the urethane-modified crystalline polyester resin is favorably 6,000 to 20,000, and more favorably 6,500 to 15,000.

When the weight average molecular weight (Mw) of the crystalline polyester-based polymerized segment that constitutes the urethane-modified crystalline polyester resin is 6,000 or more, sufficient crystalline can be obtained, and an expected sharp melt property can be obtained accordingly. Meanwhile, when the weight average molecular weight (Mw) is 20,000 or less, the number of urethane bonds in the molecules of the urethane-modified crystalline polyester resin can be sufficiently secured, and sufficient intermolecular interaction can be obtained.

The measurement of the molecular weight distribution by the GPC of the crystalline polyester-based polymerized segment is similarly performed to the aforementioned method, except that the crystalline polyester-based polymerized segment is used as the measurement sample.

Further, the weight average molecular weight (Mw) calculated from the molecular weight distribution measured by the gel permeation chromatography (GPC) of the urethane-based polymerized segment that constitutes the urethane-modified crystalline polyester resin is favorably 500 to 50,000, and more favorably 1,000 to 10,000.

The measurement of the molecular weight distribution by the GPC of the urethane-based polymerized segment is similarly performed to the aforementioned method, except that the urethane-based polymerized segment is used as the measurement sample.

In the present invention, the content ratio of the crystalline polyester-based polymerized segment in the urethane-modified crystalline polyester resin is favorably 50 to 99.5% by mass, and more favorably 60 to 96% by mass, and especially favorably 60 to 90% by mass.

The content ratio of the crystalline polyester-based polymerized segment is, to be specific, the ratio of the mass of the polyvalent carboxylic acid and the polyhydric alcohol that constitutes the crystalline polyester-based polymerized segment to the total mass of the resin material used to synthesize the urethane-modified crystalline polyester resin, that is, the total mass of the polyvalent carboxylic acid and the polyhydric alcohol that compose the crystalline polyester-based polymerized segment, and the polyhydric alcohol and polyvalent isocyanate that compose the urethane-based polymerized segment.

When the content ratio of the crystalline polyester-based polymerized segment is 50% by mass or more, a sufficient sharp melt property can be obtained, and thus excellent low-temperature fixability can be obtained. Meanwhile, when the content ratio is 99.5% by mass or less, sufficient viscoelasticity can be maintained in the binding resin as a whole, even if the temperature becomes high at the time of heat fixation. Therefore, an excessive increase in glossiness of the formed fixed image can be suppressed, and sufficient document offset resistance can be obtained.

[Acid Value of Urethane-Modified Crystalline Polyester Resin]

The urethane-modified crystalline polyester resin favorably has an acid value.

The acid value of the urethane-modified crystalline polyester resin is favorably 9 to 20 mgKOH/g, and more favorably 10 to 18 mgKOH/g.

When the acid value of the urethane-modified crystalline polyester resin is 9 mgKOH/g or more, the urethane-modified crystalline polyester resin can be emulsified and dispersed in the aqueous medium. Further, when the acid value of the urethane-modified crystalline polyester resin is 20 mgKOH/g or less, an excessive decrease in size of the fine particles of the urethane-modified crystalline polyester resin in the prepared dispersion can be prevented. Therefore, when the acid value of the urethane-modified crystalline polyester resin falls within the aforementioned range, the degree of neutralization of the carboxyl group is appropriately selected in the range from 5 to 100%, so that the average particle size of the fine particles of the urethane-modified crystalline polyester resin in the prepared dispersion can be formed to have an appropriate size, to be specific, 80 to 300 nm.

Measurement of the acid value of the urethane-modified crystalline polyester resin is performed conforming to a measuring method of the acid value of JIS K 0070. To be specific, the urethane-modified crystalline polyester resin is dissolved in a mixed solvent of acetone:water=1:1, neutralization titration is performed using potassium hydroxide according to a fixed rule, and the acid value is shown by a weight of the potassium hydroxide used to reach the end point of the neutralization per gram of the resin. The unit is mgKOH/g.

In the urethane-modified crystalline polyester resin, the carboxyl group is introduced into the molecular end of the urethane-modified crystalline polyester resin and/or the urethane-based polymerized segment that constitutes the urethane-modified crystalline polyester resin. Therefore, the urethane-modified crystalline polyester resin has the acid value.

To be specific, when the carboxyl group is configured to be introduced into the molecular end of the urethane-modified crystalline polyester resin, the carboxyl group can be introduced such that a polyvalent carboxylic acid compound is subjected to an esterification reaction with the hydroxyl group of the molecular end of the bond of the crystalline polyester-based polymerized segment and the urethane-based polymerized segment that are to be formed into the urethane-modified crystalline polyester resin. As the polyvalent carboxylic acid compound, bivalent carboxylic acids such as fumaric acid, succinic acid, maleic acid, itaconic acid, and adipic acid; trivalent carboxylic acids such as trimellitic acid and citric acid, and acid anhydrides thereof can be used. As the polyvalent carboxylic acid compound, the trivalent carboxylic acids are favorably used, and especially, trimellitate anhydride can be favorably used. The esterification reaction can be performed under the presence of a catalyst. As the catalyst, tetrabutoxy titanate, dibutyl dibutyltin oxide, p-toluenesulfonic acid, and the like can be used.

Further, when the carboxyl group is configured to be introduced into the urethane-based polymerized segment, the carboxyl group can be introduced such that a urethanization reaction is performed using a diol compound including a carboxyl group as polyhydric alcohol to be formed into the urethane-based polymerized segment. As the diol compound including a carboxyl group, dimethylol acetic acid, dimethylol propionic acid, dimethylol butanoic acid, dihydroxy succinic acid, tartaric acid, glyceric acid, dihydroxybenzoic acid, and the like can be used.

As a reaction solvent when the esterification reaction or the urethanization reaction is performed, ketone-based solvents such as acetone, methyl ethyl ketone, and methyl isobutyl ketone can be used. Further, N-methyl pyrrolidone can be favorably used to dissolve the diol compound. A dehydrated and purified reaction solvent is favorably used to prevent a side reaction.

[Method of Synthesizing Urethane-Modified Crystalline Polyester Resin]

The urethane-modified crystalline polyester resin can be synthesized as follows. A prepolymer (crystalline polyester diol or the like described below) having a hydroxyl group at both terminals, which is to serve as the crystalline polyester-based polymerized segment, and a polyurethane unit having an isocyanate group at a terminal, are respectively synthesized in advance, and the resultant objects are mixed and allowed to react each other (synthetic reaction A).

Further, the urethane-modified crystalline polyester resin can also be synthesized as follows. First, the prepolymer (crystalline polyester diol or the like described below) having a hydroxyl group at both terminals, which is to serve as the crystalline polyester-based polymerized segment, is synthesized. Then, only a polyvalent isocyanate compound, or the polyvalent isocyanate compound and polyhydric alcohol are brought to react with the hydroxyl groups of the both terminals of the prepolymer (synthetic reaction B), so that the urethane-based polymerized segment is formed.

The synthetic reaction A is performed in a solvent that can dissolve both of the prepolymer having a hydroxyl group at both terminals and the polyurethane unit having an isocyanate group at a terminal. Similarly, the synthetic reaction B is performed in a solvent that can dissolve the prepolymer having a hydroxyl group at both terminals, the polyvalent isocyanate compound, and the polyhydric alcohol. Examples of such a reaction solvent include ketone-based solvents such as acetone, methyl ethyl ketone, and methyl isobutyl ketone. A dehydrated and purified reaction solvent is favorably used to prevent a side reaction.

Further, the synthetic reactions A and B are favorably performed under heating to facilitate the synthetic reactions. A reaction temperature is favorably 50 to 80° C., although depending on the boiling point of the solvent.

[Crystalline Polyester-Based Polymerized Segment]

The crystalline polyester-based polymerized segment is made of a polyester polymer having crystalline, and is favorably made of crystalline polyester diol.

The crystalline polyester diol is formed of a polyvalent carboxylic acid containing two or more carboxyl groups in one molecule, and polyhydric alcohol containing two or more hydroxyl groups in one molecule. The crystalline polyester diol has crystalline, having hydroxyl groups at both terminals. To be specific, the crystalline polyester diol has a clear melting peak, instead of stepwise endothermic amount change in the differential scanning calorimetry (DSC).

As the polyvalent carboxylic acid, an aliphatic dicarboxylic acid is favorably used, and an aromatic dicarboxylic acid may be used together.

As the polyvalent carboxylic acid, a straight-chain aliphatic dicarboxylic acid having a 4-12C main chain including the carboxyl group, especially favorably having a 6-10C main chain, is favorably used, from the perspective that the crystalline polyester-based polymerized segment can obtain excellent crystalline.

These polyvalent carboxylic acids may be used by one type alone, or by a combination of two or more types of aforementioned examples.

Examples of the aliphatic dicarboxylic acid include saturated aliphatic dicarboxylic acids such as oxalic acid, malonic acid, fumaric acid, succinic acid, adipic acid, azelaic acid, sebacic acid, dodecanedioic acid, and n-dodecyl succinic acid, and anhydrides thereof, or 1-3C alkyl ester.

These aliphatic dicarboxylic acids may be used by one type alone, or by a combination of two or more types of aforementioned examples.

Examples of the polyvalent carboxylic acid other than the aliphatic dicarboxylic acid, aromatic dicarboxylic acids such as phthalic acid, isophthalic acid, and terephthalic acid; trimellitic acid; trivalent or more polyvalent carboxylic acids such as pyromellitic acid, and anhydrides thereof; and 1-3C alkyl ester.

The content of an aliphatic carboxylic acid in the polyvalent carboxylic acid for forming the crystalline polyester diol is favorably 80% by constitutional mole or more, and more favorably 90% by constitutional mole or more. When the content of the aliphatic carboxylic acid in the polyvalent carboxylic acid is 80% by constitutional mole or more, the crystalline of the crystalline polyester diol can be secured, and excellent low-temperature fixability can be obtained in a manufactured toner.

As the polyhydric alcohol, an aromatic diol is favorably used, and diols other than the aromatic diol may be used, as needed.

As the polyhydric alcohol, straight-chain aromatic diol having a 2-15C main chain is favorably used, and especially, an aromatic diol having a 2-10 main chain is favorably used, among aromatic diols, from the perspective that excellent crystalline can be obtained in the crystalline polyester-based polymerized segment.

These polyhydric alcohols may be used by one type alone, or by a combination of two or more types of aforementioned examples.

Examples of the aromatic diol include ethylene glycol, 1,2-propanediol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,15-pentadecanediol, 1,18-octadecane diol, and 1,20-eicosane diol.

These diols may be used by one type alone, or by a combination of two or more types of aforementioned examples.

Examples of the polyhydric alcohol other than the aromatic diol include trivalent or more polyhydric alcohols such as glycerol, pentaerythritol, trimethylolpropane, and sorbitol.

The content of the aromatic diol in the polyhydric alcohol for forming the crystalline polyester diol is favorably 80% by constitutional mole or more, and more favorably 90% by constitutional mole. When the content of the aromatic diol in the polyhydric alcohol is 80% by constitutional mole or more, the crystalline of the crystalline polyester diol can be secured, and the low-temperature fixability can be obtained in the manufactured toner.

As a method of manufacturing the crystalline polyester diol is not especially limited. The crystalline polyester diol can be manufactured using a typically polyester polymerization method in which the polyvalent carboxylic acid and the polyhydric alcohol are brought to react under a catalyst. For example, it is favorable to selectably use a direct polycondensation method or a transesterification method, depending on a type of a monomer.

Examples of the catalyst that can be used in manufacturing the crystalline polyester diol include titanium catalysts such as titanium tetraethoxide, titanium tetrapropoxide, titanium tetraisopropoxide, and titanium tetrabutoxide, and tin catalysts such as dibutyltin dichloride, dibutyltin oxide, and diphenyltin oxide.

The use ratio of the polyvalent carboxylic acid and the polyhydric alcohol, in terms of equivalence ratio [OH]/[COOH], given by equivalence of hydroxyl group [OH] of polyhydric alcohol, and equivalence of carboxyl group [COOH] of the polyvalent carboxylic acid, is favorably 1.5/1 to 1/1.5, and more favorably 1.2/1 to 1/1.2.

When the use ratio of the polyvalent carboxylic acid and the polyhydric alcohol falls within the aforementioned range, the crystalline polyester diol having a hydroxyl group at both terminals can be obtained.

[Urethane-Based Polymerized Segment]

The urethane-based polymerized segment can be obtained from the polyhydric alcohol and the polyvalent isocyanate.

As the polyhydric alcohol that can be used to form the urethane-based polymerized segment, those similar to the aforementioned examples can be used.

The polyhydric alcohols for forming the urethane-based polymerized segment can be used by one type alone, or by a combination of two or more types of the aforementioned examples.

Examples of the polyvalent isocyanate that can be used to form the urethane-based polymerized segment include 6-20C (excluding carbon in the NCO group) aromatic diisocyanate, 2-18C aliphatic diisocyanate, 4-15C alicyclic diisocyanate, 8-15C aromatic aliphatic diisocyanate, and modified diisocyanates thereof.

As a diisocyanate component for obtaining the urethane-based polymerized segment, trivalent or more polyisocyanate may be used together with the forementioned diisocyanate.

The polyvalent isocyanates for forming the urethane-based polymerized segment can be used one type alone, or by a combination of two types or more of the aforementioned examples.

Examples of the aromatic diisocyanate include 1,3- and/or 1,4-phenylene diisocyanate, 2,4- and/or 2,6-tolylene diisocyanate (TDI), 2,4'- and/or 4,4'-diphenylmethane diisocyanate (MDI), polyaryl polyisocyanate (PAPI), 1,5-naphthylene diisocyanate, 4,4',4"-triphenylmethane triisocyanate, and m- and p-isocyanato phenyl sulfonyl isocyanate.

Examples of the aliphatic diisocyanate include ethylene diisocyanate, tetramethylene diisocyanate, hexamethylene diisocyanate (HDI), dodecane methylene diisocyanate, 1,6,11-undecane diisocyanate, 2,2,4-trimethyl hexamethylene diisocyanate, ridine diisocyanate, 2,6-diisocyanato methylcaproate, bis(2-isocyanatoethyl) fumarate, bis(2-isocyanatoethyl) carbonate, 2-isocyanatoethyl-2,6-dicyanato hexanoate.

Examples of the alicyclic diisocyanate include isophorone diisocyanate (IPDI), dicyclohexylmethane-4, 4'-diisocyanate (hydrogenated MDI), cyclohexylene diisocyanate, methyl cyclohexylene diisocyanate (hydrogenated TDI), bis(2-isocyanatoethyl)-4-cyclohexene-1,2-dicarboxylate, and 2,5- and/or 2,6-norbornane diisocyanate.

Examples of the aromatic aliphatic diisocyanate include m- and/or p-xylylene diisocyanate (XDI) and $\alpha,\alpha,\alpha',\alpha'$-tetramethyl xylylene diisocyanate.

Examples of the modified diisocyanate include modified diisocyanate with a urethane group, a carbodiimide group, an allophanate group, an urea group, a biuret group, a uretdione group, a uretonimine group, an isocyanurate group, and a xazolidone group. To be specific, examples include urethane-modified MDI, urethane-modified TDI, arbodiimide-modified MDI, and trihydrocarbyl phosphatemodified MDI, and these modified diisocyanates can be used by one type alone, or by a combination of two types or more of the aforementioned examples.

[Releasing Agent]

A releasing agent is not especially limited, and various known releasing agents can be used. An examples of mineral-based wax includes montan wax, examples of petroleum wax include paraffin wax and microcrystalline wax, examples of synthetic wax include Fischer-Tropsh wax, polyethylene wax, and polypropylene wax, an example of synthetic ester wax includes a synthetic of alcohol and a fatty acid by an esterification reaction. Specific examples of the synthetic ester wax include behenyl behenate, behenyl stearate, glycerol-tri-behenate, and pentaerythritol tetra behenate.

The content ratio of the releasing agent to 100 parts by mass of the binding resin is favorably 1 to 30 parts by mass, and more favorably 5 to 20 parts by mass. When the content ratio of the releasing agent falls within the range, sufficient fixation separability can be obtained.

An example of a method of introducing the releasing agent into the toner particles includes a method of causing the crystalline resin particles to become fine particles that contain both of the crystalline resin and the releasing agent (hereinafter, this method is referred to as "releasing agent introduction method A"). However, the method is not limited to the releasing agent introduction method A, and the releasing agent can be introduced by the method below.

For example, an example of the method includes a method of adding a monomer for forming the amorphous resin in an aqueous medium under the presence of fine particles made of the releasing agent and performing polymerization to obtain releasing agent-containing amorphous resin fine particles that are releasing agent fine particles coated with the amorphous resin, and providing the resultant object to the flocculation and fusion step described below to flocculate and fuse the resultant object together with fine particle of other toner components (hereinafter, this method is referred to as "releasing agent introduction method B"). In this case, in the polymerization step described below, the monomer for forming the amorphous resin is added and polymerization is performed in the aqueous medium, under the presence of fine particle only made of the crystalline resin and fine particles only made of the releasing agent, so that coated resin fine particles that are the fine particles only made of crystalline resin coated with the amorphous resin, and the releasing agent-containing amorphous resin fine particles that are the releasing agent fine particles coated with the amorphous resin can be obtained at the same time.

Further, for example, an example of the method includes a method of dissolving, or heating and fusing the releasing agent in the monomer for forming the amorphous resin, adding the resultant object in a surfactant solution, providing mechanical energy or ultrasonic energy such as mechanical stirring to emulsify the solution, and then polymerizing the emulsified solution to obtain fine particles containing the releasing agent and the amorphous resin. Further, the method includes adding the monomer for forming the amorphous resin and performing polymerization to obtain releasing agent-containing amorphous resin fine particles that are the releasing agent and the fine particles containing the amorphous resin, coated with the amorphous resin. Then, the method includes providing the resultant object to the flocculation and fusion step described below to flocculate and fuse the resultant object together with fine particles of other toner components (hereinafter, this method is referred to as "releasing agent introduction method C"). In this case, in the polymerization step described below, the monomer for forming the amorphous resin is added and polymerization is performed in the aqueous medium, under the presence of the fine particles only made of the crystalline resin, the releasing agent, and the fine particles containing the amorphous resin, so that the coated resin fine particles in which the fine particles only made of the crystalline resin are coated with the amorphous resin, and the releasing agent-containing amorphous resin fine particles in which the releasing agent and the fine particles containing the amorphous resin are coated with the amorphous resin can be obtained at the same time.

The above releasing agent introduction methods A to C can be used in appropriate combination.

The melting point (TmW) of the releasing agent is favorably 60 to 90° C.

Measurement of the melting point of the releasing agent is similarly performed to the above method, except that the releasing agent is used as the measurement sample.

(3) Polymerization Step

In this step, a monomer for forming an amorphous resin, and an aqueous medium and a surfactant as needed, are added to a crystalline resin particle dispersion, and polymerization is performed under a reaction of a polymerization initiator, so that a dispersion of coated resin fine particles, in which the crystalline resin particles are coated with the amorphous resin is prepared.

In the dispersion prepared in this polymerization step, the coated resin fine particles in which the crystalline resin particles are coated with the amorphous resin are formed, and new particles only made of the amorphous resin (hereinafter, referred to as "amorphous resin fine particles") are formed.

[Concentration of Surfactant]

Then, in the present invention, a surfactant having the concentration that is 1 to 5 times, favorably 1.5 to 3 times the critical micellar concentration is added to the aqueous medium that serves as a reaction field of polymerization.

The concentration of the surfactant in the aqueous medium refers to, to be specific, the total concentration in the aqueous medium, of the surfactant (A) added to the dispersion provided in this step, such as the dispersion of the crystalline resin particles, and the surfactant (B) newly added in this step.

When the concentration of the surfactants in the aqueous medium is one or more times the critical micellar concentration, a sufficient polymerization speed can be obtained, and stability in the aqueous medium of the fine particles generated by the polymerization becomes high. Further, occurrence of residue of the monomer is suppressed and an offensive smell of the resultant toner can be extremely suppressed. Further, when the concentration of the surfactants in the aqueous medium is five times or less the critical micellar concentration, the number of micelles formed in the aqueous medium, that is, the number of reaction fields can be adjusted to an adequate number, and the average particle size of the generated fine particles can be adjusted to fall within an appropriate range. As a result, a flocculation speed at the time of flocculation can be suppressed, and occurrence of coarse particles can be suppressed.

Examples of a surfactant newly added to this step include those similar to the aforementioned surfactants.

[Amorphous Resin]

The amorphous resin is a resin not having a clear endothermic peak in the differential scanning calorimetry (DSC).

As the amorphous resin that constitutes the binding resin, a vinyl resin formed using an ethylenically unsaturated monomer (vinyl monomer) is favorable, to be specific, a styrene acrylic resin is favorable.

Hereinafter, a case where the amorphous resin is the vinyl resin will be described.

As the ethylenically unsaturated monomer for forming the vinyl resin, styrenes such as styrene, methylstyrene, dimethylstyrene, methoxystyrene, and methoxyacetoxystyrene; (meth)acrylates such as methyl(meth)acrylate, ethyl(meth) acrylate, n-butyl(meth)acrylate, and 2-ethylhexyl(meth) acrylate; acrylamides such as (meth)acrylamide and isopropyl (meth)acrylamide, and a vinyl monomer containing an ion dissociating group can be used.

Examples of the vinyl monomer containing an ion dissociating group include carboxyl group-containing vinyl monomer such as (meth)acrylic acid, itaconic acid, maleic acid, and fumaric acid, and half alkyl esters thereof; sulfonic acid group-containing vinyl monomers such as styrenesulfonic acid and acrylamidepropylsulfonate; phosphoric acid group-containing vinyl monomers such as phosphoric acid 2-(acryloyloxy)ethyl, and phosphoric acid 2-(methacryloyloxy)ethyl.

Among them, styrenes, (meth)acrylates, carboxyl group-containing vinyl monomers can be favorably used.

These vinyl monomers may be used by one type alone, or by a combination of two or more types of aforementioned examples.

[Molecular Weight of Amorphous Resin]

The molecular weight of the amorphous resin measured by the gel permeation chromatography (GPC) is favorably 10,000 to 70,000 in the weight average molecular weight (Mw).

When the molecular weight of the amorphous resin falls within the aforementioned range, both of sufficient low-temperature fixability and excellent heat-resistant storage property can be reliably obtained.

Measurement of the molecular weight of the amorphous resin by GPC is similarly performed to the aforementioned method, except that the amorphous resin is used as the measurement sample.

[Glass Transition Point of Amorphous Resin]

The glass transition point (Tg) of the amorphous resin is favorably 40 to 80° C., and more favorably 45 to 70° C.

When the glass transition point of the amorphous resin is 40° C. or more, sufficient thermal strength can be obtained in the toner, and a sufficient heat-resistant storage property can be obtained. Further, when the glass transition point of the amorphous resin is 80° C. or less, sufficient low-temperature fixability can be reliably obtained.

The glass transition point (Tg) of the amorphous resin is measured according to a method specified by American Society for testing and Materials (ASTM) Standard D3418-82 (DSC method), using the amorphous resin as the measurement sample.

The amount of the ethylenically unsaturated monomer for forming the amorphous resin added in this step favorably falls within the range from 95:5 to 1:2 (the mass of the crystalline resin:the mass of the ethylenically unsaturated monomer).

When the amount of the added ethylenically unsaturated monomer is the lower limit or more, the heat-resistant storage property can be reliably obtained. Further, the amount of added ethylenically unsaturated monomer is the upper limit or less, the amount of the crystalline resin in the toner particles is secured and a sufficient sharp melt property can be obtained, and the low-temperature fixability can be reliably obtained.

[Polymerization Initiator]

As a polymerization initiator, water-soluble radical polymerization initiator or oil-soluble radical polymerization initiator can be used, and a polymerization initiator having an anionic decomposition residue is favorably used.

Examples of the water-soluble radical polymerization initiator include persulfate such as potassium persulphate and ammonium persulphate; water-soluble peroxide such as hydrogen peroxide; and water-soluble azo compounds such as 4,4'-azobis(4-cyanovaleric acid), 2,2'-azobis(2-amidino propane) hydrochloride, and 2,2'-azobis(2-amidino propane) acetate. Further, potassium persulfate, ammonium persulfate, hydrogen peroxide, and the like can be used as a redox initiator in combination of a reducing agent.

Examples of the oil-soluble radical polymerization initiator include oil-soluble azo compound such as 2,2'-azobis(2-isobutyronitrile)and 2,2'-azobis(2-cyano valeronitrile); and oil-soluble peroxide such as cumene hydroperoxide.

[Chain Transfer Agent]

In the polymerization step, a typically used chain transfer agent can be used for the purpose of adjustment of the molecular weight of the vinyl resin. The chain transfer agent is not especially limited, and examples include alkyl mercaptan and mercapto fatty acid ester.

The average particle size of the fine particles in the dispersion prepared in the polymerization step is similar or roughly smaller than the average particle size of the crystalline resin particles obtained in the step of preparing a crystalline resin particle dispersion, and favorably falls within the range from 50 to 300 nm in the volume-based median diameter, and more favorably from 80 to 250 nm.

The volume-based median diameter is measured by using "UPA-150" (manufactured by Microtrac Inc.).

(4) Flocculation and Fusion Step

This step is to flocculate and fuse the coloring agent fine particles, the coated resin fine particles, and the amorphous resin fine particles, which are formed in the aforementioned step, and the releasing agent-containing amorphous resin fine particles, as needed, in the aqueous medium.

Surface states of the fine particles such as the coated resin fine particles and the amorphous resin fine particles generated in this step are approximate to each other, and thus have a high affinity to each other. Therefore, flocculation between the coated resin fine particles and the amorphous resin fine particles is stably caused, and fusion among the fine particles is firmly caused. Therefore, the toner particles can be provided with sufficient mechanical strength.

A method of flocculating and fusing the coloring agent fine particles, the coated resin fine particles, and the amorphous resin fine particles, and the releasing agent-containing amorphous resin fine particles, as needed is a method of stirring and mixing the dispersions of the respective fine particles, and adding a flocculating agent in the aqueous medium such that the concentration becomes the critical flocculation concentration or more, then heating the dispersion to have a temperature or more of the glass transition point of the vinyl resin that constitutes the amorphous resin, and of the melting point or more of the urethane-modified crystalline polyester resin that constitutes the crystalline resin, thereby to advance salting out of the fine particles and advance fusion at the same time, adding a flocculation terminator to stop the growth of the particles when the particles grows to have a desired particle size, and further continuously heating the dispersion to control the shape of the particles, as needed.

In this method, it is favorable to make the standing time after adding the flocculating agent as short as possible, and to promptly heat the dispersion to have the temperature of the glass transition point of the vinyl resin or more. Although this reason is not clear, the flocculation state of the particles varies depending on the standing time after the salting out, and there are concerns of occurrence of problems that the particle size distribution becomes unstable, and surface property of the fused particles varies. The time to heating is typically and favorably within 30 minutes, and more favorably within 10 minutes. Further, the rate of heating is favorably 1° C./minute or more. The upper limit of the rate of heating is not especially defined. However, it is favorably 15° C./minute or less, from the perspective of suppression of occurrence of coarse particles due to rapid advancing of the fusion. Further, it is essential to continue the fusion, by holding the temperature of the reaction system for a fixed time, after the reaction system has reached the temperature of the glass transition point or more. Accordingly, the growth of the toner particles and the fusion can be effectively advanced, so that durability of finally obtained toner particles can be improved.

[Flocculating Agent]

A usable flocculating agent is not especially limited. However, one selected from metal salts is favorably used. Examples of the metal salt include monovalent metal salts such as alkali metal salts of sodium, potassium, and lithium; bivalent metal salts of calcium, magnesium, manganese, and copper; and trivalent metal salts of iron and aluminum. Examples of the specific metal salt include sodium chloride, potassium chloride, lithium chloride, calcium chloride, magnesium chloride, zinc chloride, copper sulfate, aluminum chloride, magnesium sulfate, manganese sulfate. Among them, the bivalent metal salts can be especially favorably used because the flocculation can be advanced with a smaller amount. These flocculating agents may be used by one type alone, or by a combination of two or more types of aforementioned examples.

In this step, the flocculation terminator may also be used to stop the flocculation.

When the bivalent metal salt or the trivalent metal salt is used as the flocculating agent, the monovalent metal salt such as sodium chloride can be used as the flocculation terminator.

Further, as the flocculation terminator, a chelate compound that forms a metal complex, such as ethylenediaminetetraacetic acid or iminodiacetic acid can be used.

Further, when the monovalent metal salt is used as the flocculating agent, the flocculation can be stopped by causing the concentration of the metal salt to be the critical flocculation concentration or less, or by adding an acid to discharge the monovalent metal ion outside the reaction system.

When a surfactant is used in this step, those similar to the aforementioned surfactants can be used as the surfactant, for example.

(5) Ripening Step

This step is a step of controlling a heating temperature, a stirring speed, and a heating time to adjust the shape of the flocculated particles to have desired average roundness, by heating and stirring a system including the flocculated particles, and forming the toner particles having a desired shape. In this step, it is favorable to control the shape of the toner particles by thermal energy (heating).

(6) Cooling Step to (7) Drying Step

The cooling step, the filtration and washing step, and the drying step can be performed by employing various known methods.

(9) External Additive Addition Step

This external additive addition step is a step of adding and mixing an external additive to the dried toner particles, as needed.

An example of a method of adding the external additive includes a dry method of adding and mixing a powdery external additive to the dried toner particles, and as a mixing device, a mechanical mixing device such as Henschel mixer or coffee mill can be used.

[Average Particle Diameter of Toner]

The average particle size of the toner is favorably 3 to 9 μm in the volume-based median diameter, and more favorably 3 to 8 μm. The average particle size can be controlled by the concentration of the flocculating agent, the amount of addition of the organic solvent a fusion time, a composition of a polymer, and the like, when the toner is manufactured using an emulsification and flocculation method described below.

When the volume-based median diameter falls in the aforementioned range, transfer efficient becomes high, and image quality of half tone, narrow lines, and dots is improved.

The volume-based median diameter of the toner particles is measured and calculated using an measuring device connected with a computer system that is "MULTISIZER 3" (manufactured by Beckman Coulter, Inc.) equipped with data processing software "Software V3.51". To be specific, 0.02 g of toner is wetted with 20 mL of a surfactant solution (produced by 10 fold diluting a neutral detergent containing a surfactant component with pure water, for the purpose of dispersion of the toner particles), and dispersed by sonication for one minute, to produce a toner dispersion. The toner dispersion is dispensed by pipetting to a beaker that contains ISOTON II (manufactured by Beckman Coulter, Inc.) set on a sample stand, to adjust the displayed concentration to 8%. Here, the concentration is adjusted to the concentration range, so that a reproducible measurement value can be obtained. Then, the measuring instrument set to a count level of 25000, and the aperture of 50 μm. The measurement range from 1 to 30 μm is divided into 256 sections to find the frequency value in each section, and a particle size that falls on the 50% point of a volume-based cumulative fraction, from the maximum particle size, is defined as the volume-based median diameter.

[Average Roundness of Toner Particles]

An average roundness of individual toner particles that constitute the toner according to the present invention is favorably 0.930 to 1.000, and more favorably 0.950 to 0.995, from the perspective of improvement of the transfer efficiency.

In the present invention, the average roundness of the toner particles is measured using "FPIA-2100" (from Sysmex Corporation).

To be specific, the sample (toner particles) is swelled in an aqueous surfactant solution, and dispersed by sonication for one minute. Then measurement is performed using "FPIA-2100" (manufactured by Sysmex Corporation), in an HPF (high power field imaging) mode, while controlling the concentration to an appropriate range of 3,000 to 10,000 in terms of HPF count. The roundness of individual toner particles is calculated by the equation (T) below, the roundness of the respective toner particles is added, and the addition result is then divided by the total number of toner particles, so that the average roundness can be calculated.

Roundness=(Circumferential length of circle having same projected area with particle image)/(Circumferential length of projected particle image) Equation (T):

[Softening Point of Toner]

The softening point of the toner is favorably 80 to 120° C., and more favorably 90 to 110° C., from the perspective that the low-temperature fixability is obtained in the toner.

The softening point of the toner is measured by a flow tester described below.

First, under an environment of 20° C. and 50% RH, 1.1/g of sample (toner) is placed flat in a dish, and is allowed to stand for 12 hours or longer. The sample is then compressed using a forming device "SSP-10A" (manufactured by Shimadzu Corporation) under a force of 3820 kg/cm$^2$ for 30 seconds, to form a molded cylindrical sample of 1 cm in diameter. Next, the molded sample is placed under an environment of 24° C. and 50% RH, set on a flow tester "CFT-500D" (manufactured by Shimadzu Corporation) under conditions including a load of 196 N (20 kgf), a start temperature of 60° C., a preheating time of 300 seconds, and a rate of heating of 6° C./min, and upon completion of the preheating, the sample is extruded through a hole (1 mm diameter×1 mm) of a circular cylindrical die, using a 1 cm-diameter piston. A temperature $T_{offset}$ in the offset method in the fusion temperature measurement method of the heating method, with the setting of an offset value of 5 mm, is the softening point.

[External Additive]

The toner particles can be used as they are without modification to constitute the toner. However, to improve fluidity, charging performance, and cleaning performance, external additives such as a fluidizer and a cleaning assistant as so-called post-processing agents may be added to the toner particles to constitute the toner.

Examples of the post-processing agent include inorganic oxide fine particles such as silica fine particles, alumina fine particles, and titanium oxide fine particles; inorganic stearic acid compound fine particles such as aluminum stearate fine particles and zinc stearate fine particles; and inorganic titanic acid compound fine particles such as strontium titanate and zinc titanate. These post-processing agents may be used by one type alone, or by a combination of two or more types of aforementioned examples.

These inorganic fine particles are favorably subjected to surface treatment using a silane coupling agent, a titanate coupling agent, higher fatty acid, silicone oil, for improvement of the heat-resistant storage property and environmental stability.

The total addition amount of these types of external additives is 0.05 to 5 parts by mass per 100 parts by mass of the toner, and favorably 0.1 to 3 parts by mass. Further, the various types of external additives may be used in combination.

According to the method of manufacturing an toner, the toner particles are formed by fusion of the coated resin fine particles that are fine particles containing the crystalline resin, the fine particles being coated with the amorphous resin, and the fine particle containing the amorphous resin. Therefore, the electrostatic latent image developing toner that can obtain excellent low-temperature fixability, sufficient heat-resistance storage property, and excellent mechanical strength can be reliably manufactured.

[Developer]

The toner may be used as a magnetic or nonmagnetic single-component developer, or may be used as a two-component developer after mixed with a carrier.

The carrier is magnetic particles made of any of known materials including metals such as iron, ferrite, and magnetite, and alloys of these metals and metals such as aluminum and lead. Among them, ferrite particles are favorably used. Further, a coated carrier in which surfaces of magnetic particles are coated with a coating agent such as a resin, or a resin-dispersed carrier in which the magnetic fine powder is dispersed in a binder resin, may be used as the carrier.

The carrier favorably has a volume-average particle size of 15 to 100 μm, and more favorably 25 to 80 μm.

[Image Forming Device]

The aforementioned toner can be used in a typical electrophotographic image formation method. As an image forming device that performs such an image formation method, an image forming device including: a photoreceptor that is an electrostatic latent image carrier; charging means for providing a surface of the photoreceptor with a uniform potential by corona discharge having the same polarity as the toner; exposure means for forming an electrostatic latent image by performing exposure of an image on the uniformly charged surface of the photoreceptor, based on image data; developing means for conveying the toner to the surface of the photoreceptor, developing the electrostatic latent image to form a toner image; transfer means for transferring the toner image on a transfer material through an intermediate transfer body, as needed; and fixing means for heating and fixing the toner image on the transfer material, can be used.

Further, the aforementioned toner can be suitably used in those having a relatively low fixing temperature (a surface temperature of a fixing member), which is 100 to 200° C.

As described above, embodiments of the present invention have been specifically described. However, embodiments of the present invention are not limited to the aforementioned examples, and various changes can be added.

EXAMPLES

Hereinafter, specific examples of the present invention will be described. However, the present invention is not limited to these examples.

Synthesis Example of Crystalline Polyester Diol [1]

In a reaction vessel equipped with a cooling tube, a stirrer, a decompression device, and a nitrogen gas feeding pipe, a diol component: 430 parts by mass of 1,6-hexanediol, a dicarboxylic acid component: 691 parts by mass of a sebacic acid, and 2 parts by mass of tetrabutoxy titanate as a polymerization catalyst were placed. The temperature was raised to 180° C., and the solution was allowed to react for 5 hours under distilling the water generated in a nitrogen gas stream at 180° C. Further, the solution was placed under a reduced pressure of 0.007 to 0.026 MPa and allowed to react under distilling the water. The resultant object was taken out when the acid value became 0.1 mgKOH/g. The crystalline polyester diol [1] was obtained, accordingly.

The weight average molecular weight (Mw) of the crystalline polyester diol [1] was 8,000, and the melting point was 67° C.

Synthesis Examples of Crystalline Polyester Diols [2] to [4]

Crystalline polyester diols [2] to [4] were similarly obtained, except that the examples complied with the formulations of Table 1 below in the synthesis example of the crystalline polyester diol [1].

TABLE 1

| | Diol | | Dicarboxylic acid | | | |
|---|---|---|---|---|---|---|
| | Compound | Addition Amount (parts by mass) | Compound | Addition Amount (parts by mass) | Mw | Melting Point (° C.) |
| Crystalline polyester diol [1] | 1,6-hexanediol | 430 | Sebacic acid | 691 | 8000 | 67 |
| Crystalline polyester diol [2] | Ethylene glycol | 226 | Sebacic acid | 691 | 8100 | 70 |
| Crystalline polyester diol [3] | 1,4-butanediol | 328 | Sebacic acid | 691 | 7900 | 65 |
| Crystalline polyester diol [4] | 1,9-nonanediol | 583 | Dodecanedioic acid | 787 | 8000 | 71 |

Synthesis Example of Urethane-Modified Crystalline Polyester Resin [1]

In a reaction vessel equipped with a stirring device, a cooling tube, a nitrogen gas feeding pipe, and a decompression device, 500 parts by mass of dehydrated methyl ethyl ketone, 452 parts by mass of crystalline polyester diol [1], and 15 parts by mass of 2,2-dimethylol propionic acid were placed, and stirred at 60° C. for 1 hour and dissolved. Next, 33 parts by mass of hexamethylene diisocyanate were put in the solution in a nitrogen gas stream. The inner temperature was raised to 80° C. under stirring the solution, and the solution was allowed to react for 12 hours, and then 13 parts by mass of trimellitate anhydride and 0.5 parts by mass of tetrabutoxy titanate as a catalyst were added, and the solution was allowed to react at 120° C. for 5 hours. Then, the methyl ethyl ketone was distilled, whereby the urethane-modified crystalline polyester resin [1] was obtained.

The weight average molecular weight (Mw) of the urethane-modified crystalline polyester resin [1] was 35,000, the number average molecular weight (Mn) was 21,000, the acid value was 13 mgKOH/g, and the melting point (Tm) was 66° C.

Synthesis Examples of Urethane-Modified Crystalline Polyester Resins [2] to [4]

The urethane-modified crystalline polyester resins [2] to [4] were similarly obtained, except that crystalline polyester diols [2] to [4] were respectively used in place of the crystalline polyester diol [1], in the synthesis example of the urethane-modified crystalline polyester resin [1].

The weight average molecular weights (Mw), the melting points (Tm), and the acid values of the urethane-modified crystalline polyester resins [2] to [4] are illustrated in Table 2.

TABLE 2

| Urethane-modified crystalline polyester resin No. | Crystalline polyester diol No. | Mw | Tm [° C.] | Acid value [mgKOH/g] |
|---|---|---|---|---|
| [1] | [1] | 35000 | 67 | 13 |
| [2] | [2] | 34000 | 70 | 13 |
| [3] | [3] | 36000 | 65 | 12 |
| [4] | [4] | 35000 | 71 | 13 |

Preparation Example of Urethane-Modified CrystallinePolyester Resin Fine Particles Dispersion [D1]

100 parts by mass of urethane-modified crystalline polyester resin [1] was dissolved in 400 parts by mass of methyl ethyl ketone. Further, 1 parts by mass of trimethylamine was added, and neutralization was performed, so that the oil phase was prepared.

Meanwhile, 0.8 parts by mass of sodium dodecyl sulfate was dissolved in 400 parts by pass of pure water, so that an aqueous phase (surfactant solution) was obtained.

The aqueous phase was dropped under stirring the oil phase. Further, the particle size was measured using the laser particle size distribution measuring apparatus "LA-920" (manufactured by Horiba, Ltd.) under stirring at 8000 rpm. The stirring was stopped when the average particle size was stabilized. Then, the methyl ethyl ketone was removed under a reduced pressure from the emulsified liquid, whereby the urethane-modified crystalline polyester resin fine particle dispersion [D1] was prepared.

The volume-based median diameter of the fine particles was 210 nm and the solid content concentration was 20%, in the urethane-modified crystalline polyester resin fine particle dispersion [D1].

Preparation Example of Urethane-Modified Crystalline Polyester Resin Fine Particles Dispersions [D2] to [D4]

Urethane-modified crystalline polyester resin fine particle dispersions [D2] to [D4] were similarly obtained, except that urethane-modified crystalline polyester resins [2] to [4] were respectively used, in place of the urethane-modified crystalline polyester resin [1], and the addition amount of trimethylamine was the mole amount corresponding to the acid value of the urethane-modified crystalline polyester resin to be used, in the preparation example of the urethane-modified crystalline polyester resin fine particle dispersion [D1].

Synthesis Example of Crystalline Polyester Resin [5]

In a reaction vessel equipped with a cooling tube, a stirrer, a decompression device, and a nitrogen gas feeding pipe, a diol component: 328 parts by mass of 1,4-butanediol, a dicarboxylic acid component: 736 parts by mass of sebacic acid, and 3.5 parts by mass of tetrabutoxy titanate were placed. The temperature was raised to 180° C., and the solution was allowed to react for 5 hours under distilling water generated in a nitrogen gas stream at 180° C. Further, the solution was placed to react under a reduced pressure of 0.007 to 0.026 MPa under distilling water, and was taken out when the acid value became 14 mgKOH/g, whereby the crystalline polyester resin [5] was obtained.

The weight average molecular weight (Mw) of the crystalline polyester resin [5] was 15,000, the melting point was 64° C., and the acid value was 14 mgKOH/g.

Preparation Example of Crystalline Polyester Resin/Releasing Agent Composite Fine Particles Dispersion [D5]

100 parts by mass of crystalline polyester resin [5] was dissolved in 250 parts by mass of methyl ethyl ketone. Further, 1.8 parts by mass of trimethylamine was added, and neutralization was performed. 25 parts by mass of pentaerythritol tetrabehenate was added and dissolved while heated to 85° C. under stirring, so that an oil phase was prepared.

Meanwhile, 1.8 parts by mass of sodium dodecyl sulfate was dissolved in 400 parts by mass of pure water, so that an aqueous phase (surfactant solution) was obtained.

The aqueous phase was dropped in a state of being heated to 85° C. under stirring the oil phase. Further, the particle size was measured using the laser particle size distribution measuring apparatus "LA-920" (manufactured by Horiba, Ltd.) under stirring at 6000 rpm. The stirring was stopped when the average particle size was stabilized. Then, the methyl ethyl ketone was removed under a reduced pressure from the emulsified liquid, whereby the crystalline polyester resin/releasing agent composite fine particle dispersion [D5] was prepared.

The volume-based median diameter of the fine particles in the crystalline polyester resin/releasing agent composite fine particle dispersion [D5] was 215 nm, and the solid content concentration was 22%. Further, the concentration of the surfactant was 1.9 times the critical micellar concentration (CMC).

Preparation Example of Releasing Agent Fine Particles Dispersion [W]

A releasing agent: 60 parts by mass of pentaerythritol tetrabehenate was held to 90° C. and fused. This fused solution was put in a surfactant solution, which was prepared such that 15 parts by mass of sodium dodecyl sulfate was dissolved in 225 parts by mass of deionized water and heated to 90° C., then subjected to ultrasonic irradiation, and cooled to a room temperature, whereby the releasing agent fine particle dispersion [W] was obtained.

The average particle size of the releasing agent fine particle dispersion [W] was 180 nm, and the solid content concentration was 20%. Further, the concentration of the surfactant was 28.2 times the critical micellar concentration (CMC).

Preparation Example of Coated Resin Fine Particles Dispersion [DB1]

In a reaction vessel equipped with a stirring device, a cooling tube, a thermometer, and a nitrogen gas feeding pipe, 550 parts by mass of urethane-modified crystalline polyester resin fine particle dispersion [D1], 100 parts by mass of releasing agent fine particle dispersion [W], 2.5 parts by mass of sodium dodecyl sulfate, and 750 parts by mass of pure water were added, and the inner temperature was raised to 80° C. under stirring in a nitrogen gas stream. Further, a polymerization initiator solution prepared by dissolving 4.5 parts by mass of potassium persuphate in 50 parts by mass of pure water was added, and a monomer solution prepared by mixing 140 parts by mass of styrene, 50 parts by mass of n-butyl acrylate, 10 parts by mass of methacrylic acid, and 1.37 parts by mass of n-octylmercaptan was dropped for 1 hour. After the drop, a reaction was performed for 5 hours at 80° C. in a nitrogen gas stream, and the inner temperature was raised to 85° C. and a reaction was performed for 1 hour. Then, the solution was cooled to the room temperature and filtrated, whereby the coated resin fine particle dispersion [DB1] was obtained. The concentration of the surfactant was 1.21 times the critical micellar concentration (CMC).

The volume-based median diameter of the fine particles in the coated resin fine particle dispersion [DB1] was 220 nm, the weight average molecular weight (Mw) was 28,000, and the glass transition point (Tg) was 45° C.

Preparation Examples of Coated Resin Fine Particles Dispersions [DB2] to [DB4]

Coated resin fine particle dispersions [DB2] to [DB4] were similarly obtained, except that urethane-modified crystalline polyester resin fine particle dispersions [D2] to [D4] were respectively used, in place of the urethane-modified crystalline polyester resin fine particle dispersion [D1], in the preparation example of the coated resin fine particle dispersion [DB1].

Preparation Example of Coated Resin Fine Particles Dispersion [DB5]

In a reaction vessel equipped with a stirring device, a cooling tube, a thermometer, and a nitrogen gas feeding pipe, 625 parts by mass of crystalline polyester resin/releasing agent composite fine particle dispersion [D5], 5.98 parts by mass ofsodium dodecyl sulfate, and 900 parts by mass of pure water were added, and the inner temperature was raised to 80° C. under stirring in a nitrogen gas stream. Further, a polymerization initiator solution prepared by dissolving 4 parts by mass of potassium persulphate in 70 parts by mass of pure water was added, and a monomer solution prepared by mixing 140 parts by mass of styrene, 50 parts by mass of n-butyl acrylate, 10 parts by mass of methacrylic acid, and 1.37 parts by mass of n-octylmercaptan was dropped for 1 hour. After the drop, a reaction was performed for 5 hours at 80° C. in a nitrogen gas stream, and the inner temperature was raised to 85° C. Then, a reaction was performed for 1 hour, and then the solution was cooled to the room temperature and filtrated, whereby the coated resin fine particle dispersion [DB5] was obtained. The concentration of the surfactant was 2.5 times the critical micellar concentration (CMC).

The volume-based median diameter of the fine particles in the coated resin fine particle dispersion [DB5] was 200 nm, the weight average molecular weight (Mw) was 28,000, and the glass transition point (Tg) was 45° C.

Preparation Example of Styrene Acrylic Resin Fine Particles Dispersion [DX]

136 parts by mass of styrene, 52 parts by mass of n-butyl acrylate, 12 parts by mass of methacrylic acid, and 43 parts by mass of pentaerythritol tetrabehenate were heated to 85° C., and a monomer solution was prepared. A solution prepared by dissolving 4.5 parts by mass of sodium dodecyl sulfate in the 502 parts bymass of pure water was held to 85° C., and the monomer solution was added thereto, and the solution was stirred with "ClEARMIX" (manufactured by M Technique Co., Ltd.) at a high speed, so that a monomer emulsified liquid was prepared.

The emulsified liquid was put in a reaction vessel equipped with a stirring device, a cooling tube, a thermometer, and a nitrogen gas feeding pipe, 400 parts by mass of pure water was added thereto, and was stirred at 80° C. in a nitrogen gas stream. Further, 1.4 parts by mass of n-octylmercaptan was added and a polymerization initiator solution prepared by dissolving 4 parts by mass of potassium persulphate in 70 parts by mass of pure water was added, and a reaction was performed at 80° C. for 4 hours. Then, the inner temperature was raised to 85° C., a reaction was performed for 1 hour, and the solution was cooled to the room temperature and filtrated, whereby the styrene acrylic resin fine particle dispersion [DX] was obtained.

The volume-based median diameter of styrene acrylic resin fine particles in the styrene acrylic resin fine particle dispersion [DX] was 220 nm, the weight average molecular weight (Mw) was 28,000, and the glass transition point (Tg) was 50° C. The concentration of the surfactant was 1.96 times the critical micellar concentration (CMC).

Preparation Example of Coated Resin Particle Dispersion [DB6]

550 parts by mass of styrene acrylic resin fine particle dispersion [DX]and 200 parts by mass of urethane-modified crystalline polyester resin fine particle dispersion [D2] were placed in a reaction vessel equipped with a stirring device, a cooling tube, a thermometer, and a nitrogen gas feeding pipe, and 200 parts by mass of pure water and 2.5 parts by mass of sodium dodecyl sulfate were added. The solution was placed in a nitrogen gas stream and stirred at 80° C. Here, a polymerization initiator solution prepared by dissolving 2 parts by mass of potassium persulphate in 35 parts by mass of pure water was added, and further, a monomer solution made of 68 parts by mass of styrene, 26 parts by mass of n-butyl acrylate, 5 parts by mass of methacrylic acid, and 0.7 parts by mass of n-octylmercaptan was dropped for 1 hour, and a reaction was performed at 80° C. for 4 hours. Then, the inner temperature was raised to 85° C., and a reaction was performed for 1 hour, and the solution was cooled and filtrated, whereby the coated resin particle dispersion [DB6] was obtained. The concentration of the surfactant was 1.87 times the critical micellar concentration (CMC).

The volume-based median diameter of the fine particles in the coated resin fine particle dispersion [DB6] was 230 nm, and the weight average molecular weight (Mw) was 28,700.

Preparation Example of Coated Resin Particle Dispersion [DB7]

A coated resin fine particle dispersion [DB7] was similarly obtained, except that sodium dodecyl sulfate was not added in the preparation example of the coated resin fine particle dispersion [DB1]. The concentration of the surfactant was 0.43 times the critical micellar concentration (CMC). When filtration was performed after completion of polymerization, residues were confirmed. These residues were the urethane-modified crystalline polyester resin [1].

The volume-based median diameter of the fine particles in the coated resin fine particle dispersion [DB7] was 240 nm, and the weight average molecular weight (Mw) was 28,500.

Preparation Example of Coated Resin Particle Dispersion [DB8]

A coated resin fine particle dispersion [DB8] was similarly obtained, except that the addition amount of sodium dodecyl sulfate was changed to 18 parts by mass, in the preparation example of the coated resin fine particle dispersion [DB1]. The concentration of the surfactant was 5.56 times the critical micellar concentration (CMC). No residue after filtration was confirmed.

The volume-based median diameter of the fine particles in the coated resin fine particle dispersion [DB8] was 160 nm, and the weight average molecular weight (Mw) was 28,500.

Preparation Example of Dispersion of Coloring Agent Fine Particles [C]

30 parts by mass of a cyan pigment (C. I. pigment blue 15:3) was added to a surfactant solution prepared by dissolving 10 parts by mass of sodium dodecyl sulfate in 160 parts by mass of pure water, and high-speed stirring was performed using "ClEARMIX" (manufactured by M Technique Co., Ltd.), whereby a cyan coloring agent fine particle dispersion [C] was obtained.

The average particle size of the coloring agent fine particle dispersion [C] was 210 nm, and the solid content concentration was 15%.

Example 1

Manufacturing Example of Toner [1]

In a reaction vessel equipped with a cooling tube, a thermometer, and a stirrer, 750 parts by mass of the coated resin fine particle dispersion [DB1], 45 parts by mass of the coloring agent fine particle dispersion [C], 500 parts by mass of pure water, and 6.2 parts by mass of polyoxyethylene(2) lauryl ether sodium sulfate (active component: 27%) were placed, and a 1N-sodium hydroxide solution was added under stirring and pH was adjusted to 10.

Further, a magnesium chloride solution prepared by dissolving 20 parts by mass of magnesium chloride/hexahydrate in 20 parts by mass of pure water was added, and then the temperature was raised to 80° C. under stirring. The inner temperature was maintained to 80° C., and the solution was sampled under stirring. The particle size was measured using a particle size distribution measuring apparatus "COULTER COUNTER 3" (manufactured by Beckman Coulter, Inc.). A sodium chloride solution prepared by dissolving 1.5 parts by mass of sodium chloride in 7.5 parts by mass of pure water was added when the volume-based median diameter reached 5.8 μm, and the growth of the particle size was stopped. Further, the roundness was measured using a flow-type particle imaging instrument "FPIA-2100" (manufactured by Sysmex Corporation). The solution was cooled to the room temperature when the average roundness became 0.96. After washing with purewater and filtration were repeatedly performed for the dispersion, the dispersion was dried, whereby the toner particles [1] were obtained.

The volume-based median diameter of the toner particles [1] was 5.83 μm, and the average roundness was 0.962.

1% by mass of hydrophobic silica (the number-average primary particle size=10 nm, and the hydrophobicity=60) was added to the resultant toner particles [1], the toner particles were mixed with "HENSCHEL MIXER" (manufactured by Mitsui Miike Co., Ltd.), and then coarse particles were removed using a sieve with an opening of 45 μm, whereby the toner [1] was obtained.

Examples 2 to 6

Manufacturing Examples of Toners [2] to [6]

Toner particles [2] to [6] were similarly obtained, except that coated resin fine particle dispersions [DB2] to [DB6]

were respectively used, in place of the coated resin fine particle dispersion [DB1] in the manufacturing example of the toner [1], and toners [2] to [6] were obtained by mixing hydrophobic silica similarly to the manufacturing example of the toner [1].

Comparative Example 1

Manufacturing Example of Toner [7]

In a reaction vessel equipped with a cooling tube, a thermometer, and a stirrer, 375 parts by mass of styrene acrylic resin fine particle dispersion [DX], 375 parts by mass of the urethane-modified crystalline polyester resin fine particle dispersion [D2], 45 parts by mass of the coloring agent fine particle dispersion [C], 500 parts by mass of pure water, 6.2 parts by mass of polyoxyethylene (2) lauryl ether sodium sulfate (the active component: 27%) were placed, and a 1N-sodium hydroxide solution was added under stirring and pH was adjusted to 10.

Further, a magnesium chloride solution prepared by dissolving 20 parts by mass of magnesium chloride/hexahydrate in 20 parts by mass of pure water was added, and then the temperature was raised to 80° C. under stirring. The inner temperature was maintained to 80° C., and the solution was sampled under stirring. The particle size was measured using a particle size distribution measuring apparatus "COULTER COUNTER 3" (manufactured by Beckman Coulter, Inc.). A sodium chloride solution prepared by dissolving 1.5 parts by mass of sodium chloride in 7.5 parts by mass of pure water was added when the volume-based median diameter reached 5.8 μm, and the growth of the particle size was stopped. Further, the roundness was measured using a flow-type particle imaging instrument "FPIA-2100" (manufactured by Sysmex Corporation). The solution was cooled to the room temperature when the average roundness became 0.96. After washing with pure water and filtration were repeatedly performed for the dispersion, the dispersion was dried, whereby the toner particles [7] were obtained.

The volume-based median diameter of the toner particles [7] was 5.91 μm and the average roundness was 0.965.

1% by mass of hydrophobic silica (the number-average primary particle size=10 nm, and the hydrophobicity=60) was added to the resultant toner particles [7], the toner particles were mixed with "HENSCHEL MIXER" (manufactured by Mitsui Miike Co., Ltd.), and then coarse particles were removed using a sieve with an opening of 45 μm, whereby the toner [7] was obtained.

Comparative Examples 2 and 3

Manufacturing Examples of Toner [8] and [9]

Toner particles [8] and [9] were similarly obtained, except that coated resin fine particle dispersion [DB7] and [DB8], in place of the coated resin fine particle dispersion [DB1], in the manufacturing example of the toner [1], and toners [8] and [9] were obtained by mixing hydrophobic silica similarly to the manufacturing example of the toner [1].

The average particle size of the toner [8] was 6.74 μm in the volume-based median diameter, and the average roundness was 0.948.

The average particle size of the toner [9] was 6.59 μm in the volume-based median diameter, and the average roundness was 0.966.

Manufacturing Examples of Developers 1 to 9

A ferrite carrier coated with an acrylic resin and having the volume average particle size of 35 μm was added to each of the toners [1] to [9] to cause the concentrations of the toners to be 6% by mass, and was mixed using a V blender, so that developers [1] to [9] were manufactured.

Evaluation below was conducted about the aforementioned developers [1] to [9].

(1) Low-Temperature Fixability

A solid image with an amount of adhesion of toner of 9 g/m$^2$ was fixed and output at a linear speed of 420 mm/sec, while varying the fixing temperature from 180 to 100° C. at 5° C. intervals, using "BIZHUB" (manufactured by Konica Minolta, Inc.), which has been modified to be able to change the fixing temperature. The image portion was valley folded, and a minimum fixing temperature, of fixing temperatures at which the image is separated and the width appearing on the folded portion becomes 0.5 mm or less, was employed as the minimum fixing temperature (MFT).

The results were illustrated in Table 3. When the minimum fixing temperature is 140° C. or less, the toner is determined eligible in the present invention.

(2) Fracture Resistance

A stirring test was performed, in which a developer was put in a vessel, stirred for 1 hour using a rotor, then taken out, and divided into the carrier and the toner. The particle size distribution of the toner before and after the stirring test was measured using "FPIA-2100", and the amount (number %) of toner particles (fractured toner particles) having the particle size of 2 μm or less was calculated. The fracture resistance was evaluated by comparing the amount of fractured toner particles before and after the stirring test.

The results are illustrated in Table 3. When the amount of fractured toners after the stirring test is 5.0 number % or less, the toner is determined eligible in the present invention.

TABLE 3

| | Toner No. | Lowest fixing temperature [° C.] | Amount of fractured toner particles [number %] Before stirring test | After stirring test |
|---|---|---|---|---|
| Example 1 | [1] | 110 | 0.21 | 0.25 |
| Example 2 | [2] | 115 | 0.28 | 0.3 |
| Example 3 | [3] | 120 | 0.19 | 0.27 |
| Example 4 | [4] | 115 | 0.22 | 0.25 |
| Example 5 | [5] | 120 | 0.18 | 0.21 |
| Example 6 | [6] | 115 | 0.25 | 0.38 |
| Comparative Example 1 | [7] | 120 | 1.38 | 5.34 |
| Comparative Example 2 | [8] | 155 | 2.38 | 7.92 |
| Comparative Example 3 | [9] | 140 | 2.77 | 7.23 |

Although the present invention has been described and illustrated in detail, it is clearly understood that the same is by way of illustrated and example only and is not to be taken by way of limitation, the scope of the present invention being interpreted by terms of the appended claims.

What is claimed is:

1. A method of manufacturing an electrostatic latent image developing toner comprising toner particles comprising a binding resin made of an amorphous resin and a crystalline resin, a releasing agent, and a coloring agent, the method comprising:

adding a monomer for forming the amorphous resin, in an aqueous medium, wherein the aqueous medium contains:

a surfactant having concentration of one to five times critical micellar concentration, fine particles (A) containing the crystalline resin, and a releasing agent, the release agent being present as the fine particles (A) further containing the releasing agent, fine particles (B) containing the releasing agent or, fine particles (C) containing the releasing agent and the amorphous resin;

performing polymerization to obtain fine particles containing the amorphous resin, the fine particles (A) coated with the amorphous resin, and optionally the fine particles (B) or (C) coated with the amorphous resin; and flocculating and fusing at least the fine particles containing the amorphous resin, the fine particles (A) coated with the amorphous resin, fine particles containing the coloring agent, and optionally the fine particles (B) or (C) coated with the amorphous resin, in an aqueous medium, under presence of a flocculating agent, to obtain the toner particles, wherein the crystalline resin contains a urethane-modified crystalline polyester resin that is a combination of a crystalline polyester-based polymerized segment and a urethane-based polymerized segment, a carboxyl group is included in a molecular end of the urethane-modified crystalline polyester resin and/or in the urethane-based polymerized segment that constitutes the urethane-modified crystalline polyester resin, an acid value of the urethane-modified crystalline polyester resin is 9 to 20 mgKOH/g, the crystalline resin further comprises a crystalline polyester resin, and a melting point of the crystalline resin is 50 to 90° C.

2. The method of manufacturing an electrostatic latent image developing toner according to claim 1, wherein an ethylenically unsaturated monomer containing a carboxyl group is used as the monomer for forming the amorphous resin.

3. The method of manufacturing an electrostatic latent image developing toner according to claim 1, wherein the fine particles (A) containing the crystalline resin further comprise the releasing agent.

4. The method of manufacturing an electrostatic latent image developing toner according to claim 1, wherein the aqueous medium contains the fine particles (C) containing the amorphous resin and the releasing agent.

5. The method of manufacturing an electrostatic latent image developing toner according to claim 4, wherein the fine particles (C) are obtained by polymerizing fine particles that comprise the monomer for forming the amorphous resin and the releasing agent, which are mixed and emulsified in an aqueous medium.

6. The method of manufacturing the electrostatic latent image developing toner according to claim 1, wherein in the polymerization, the fine particles (A) coated with the amorphous resin and the fine particles (B) coated with the amorphous resin are obtained by adding the monomer for forming the amorphous resin and performing the polymerization, under presence of the fine particles (A) and (B) , and fine particles (B) coated with the amorphous resin are flocculated and fused, together with the fine particles containing the amorphous resin, the fine particles (A) coated with the, amorphous resin, and the fine particles containing the coloring agent.

7. A method of manufacturing an electrostatic latent image developing toner comprising toner particles comprising a binding resin made of an amorphous resin and a crystalline resin, a releasing agent, and a coloring agent, the method comprising:

adding a monomer for forming the amorphous resin, in an aqueous medium, wherein the aqueous medium contains:

a surfactant having concentration of one to five times critical micellar concentration, fine particles (A) containing the crystalline resin, and fine particles (C) containing the releasing agent and the amorphous resin, wherein the fine particles (C) are obtained by polymerizing fine particles that comprise the monomer for forming the amorphous resin and the releasing agent, which are mixed and emulsified in as aqueous medium;

performing polymerization to obtain fine particles containing the amorphous resin, the fine particles (A) coated with the amorphous resin, and the fine particles (C) coated with the amorphous resin; and flocculating and fusing at least the fine particles containing the amorphous resin, the fine particles (A) coated with the amorphous resin, fine particles containing the coloring agent, and the fine particles (C) coated with the amorphous resin, in an aqueous medium, under presence of a flocculating agent, to obtain the toner particles.

8. The method of manufacturing an electrostatic latent image developing toner according to claim 7, wherein the crystalline resin is made of a crystalline polyester resin and/or a urethane-modified crystalline polyester resin that is a combination of a crystalline polyester-based polymerized segment and a urethane-based polymerized segment, and a melting point of the crystalline resin is 50 to 90° C.

9. The method of manufacturing an electrostatic latent image developing toner according to claim 8, wherein, the crystalline resin contains the urethane-modified crystalline polyester resin, a carboxyl group is included in a molecular end of the urethane-modified crystalline polyester resin and/or in the urethane-based polymerized segment that constitutes the urethane-modified crystalline polyester resin, and an acid value of the urethane-modified crystalline polyester resin is 9 to 20 mgKOH/g.

10. The method of manufacturing an electrostatic latent image developing toner according to claim 7, wherein an ethylenically unsaturated monomer containing a carboxyl group is used as the monomer for forming the amorphous resin.

11. The method of manufacturing an electrostatic latent image developing toner according to claim 7, wherein the fine particles (A) containing the crystalline resin further comprise the releasing agent.

12. A method of manufacturing an electrostatic latent image developing toner comprising toner particles comprising a binding resin made of an amorphous resin and a crystalline resin, a releasing agent, and a coloring agent, the method comprising:

adding a monomer for forming the amorphous resin, in an aqueous medium, wherein the aqueous medium contains:

a surfactant having concentration of one to five times critical micellar concentration, fine particles (A) containing the crystalline resin, and fine particles (B) containing the releasing agent;

performing polymerization to obtain fine particles containing the amorphous resin, the fine particles (A) coated with the amorphous resin, and the fine particles (B) coated with the amorphous resin; and flocculating and fusing at least the fine particles containing the amorphous resin, the fine particles (A) coated with the amorphous resin, fine particles containing the coloring agent, and the fine particles (B) coated with the amorphous resin, in an aqueous medium, under presence of a flocculating agent, to obtain the toner particles.

13. The method of manufacturing an electrostatic latent image developing toner according to claim 12, wherein the crystalline resin is made of a crystalline polyester resin and/or a urethane-modified crystalline polyester resin that is a combination of a crystalline polyester-based polymerized segment and a urethane-based polymerized segment, and a melting point of the crystalline resin is 50 to 90° C.

14. The method of manufacturing an electrostatic latent image developing toner according to claim 13, wherein, the crystalline resin contains the urethane-modified crystalline polyester resin, a carboxyl group is included in a molecular end of the urethane-modified crystalline polyester resin and/or in the urethane-based polymerized segment that constitutes the urethane-modified crystalline polyester resin, and an acid value of the urethane-modified crystalline polyester resin is 9 to 20 mgKOH/g.

15. The method of manufacturing an electrostatic latent image developing toner according to claim 12, wherein an ethylenically unsaturated monomer containing a carboxyl group is used as the monomer for forming the amorphous resin.

16. The method of manufacturing an electrostatic latent image developing toner according to claim 12, wherein the fine particles (A) containing the crystalline resin further comprise the releasing agent.

* * * * *